US010040213B2

(12) United States Patent
Nielsen

(10) Patent No.: US 10,040,213 B2
(45) Date of Patent: Aug. 7, 2018

(54) METHOD AND ARRANGEMENT FOR PORTION CUTTING OF FOOD ITEMS, AND USE OF A CUTTING DEVICE IN THE ARRANGEMENT

(75) Inventor: Ulrich Carlin Nielsen, Ry (DK)

(73) Assignee: MAREL A/S, Arhus N (DK)

( * ) Notice: Subject to any disclaimer, the term of this patent is extended or adjusted under 35 U.S.C. 154(b) by 710 days.

(21) Appl. No.: 10/599,602

(22) PCT Filed: Mar. 22, 2005

(86) PCT No.: PCT/DK2005/000194

§ 371 (c)(1),
(2), (4) Date: Nov. 9, 2006

(87) PCT Pub. No.: WO2005/097438

PCT Pub. Date: Oct. 20, 2005

(65) Prior Publication Data

US 2007/0202229 A1 Aug. 30, 2007

(30) Foreign Application Priority Data

Apr. 5, 2004 (DK) ..... 2004 00552

(51) Int. Cl.
*B26D 3/18* (2006.01)
*B26D 7/30* (2006.01)
(Continued)

(52) U.S. Cl.
CPC ..... *B26D 11/00* (2013.01); *B26D 3/18* (2013.01); *B26D 5/00* (2013.01); *B26D 7/30* (2013.01);
(Continued)

(58) Field of Classification Search
CPC . Y10T 83/2074; Y10T 83/525; Y10T 83/155; Y10T 83/182; Y10T 83/0524;
(Continued)

(56) References Cited

U.S. PATENT DOCUMENTS 3,841,186 A * 10/1974 Demerin ..... 83/404.2
4,875,254 A * 10/1989 Rudy et al. ..... 452/157
(Continued)

FOREIGN PATENT DOCUMENTS

CN 1287789 A 3/2001
DE 9412378 U1 9/1994
(Continued)

OTHER PUBLICATIONS

International Search Report dated Jun. 1, 2005.
International Search Report for Appl. No. PCT/DK2005/000194 dated Jun. 1, 2005.

*Primary Examiner* — Laura M Lee
(74) *Attorney, Agent, or Firm* — Workman Nydegger

(57) ABSTRACT

An apparatus for portion cutting food items includes a first cutting device which comprises a cutting unit for the cutting of food items into strips. The apparatus includes one or more additional cutting devices, each comprising a cutting unit for cutting the strips into pieces of predetermined weight and dimensions. Measuring means are arranged in the first cutting device for scanning at least one of a shape, a structure and a dimension of the food item. The apparatus further comprises processor means with a control program for the planning of a portion-cutting profile on the basis of the scanning.

23 Claims, 1 Drawing Sheet

(51) Int. Cl.
*B26D 11/00* (2006.01)
*B26D 5/00* (2006.01)

(52) U.S. Cl.
CPC ..... *Y10T 83/0524* (2015.04); *Y10T 83/155* (2015.04); *Y10T 83/182* (2015.04); *Y10T 83/2074* (2015.04); *Y10T 83/525* (2015.04)

(58) Field of Classification Search
CPC . B26D 11/00; B26D 3/18; B26D 5/00; B26D 7/30
USPC ... 83/49, 35, 39, 77, 75.5, 73, 74, 360, 363, 83/364, 367–371, 932; 452/157
See application file for complete search history.

(56) References Cited

U.S. PATENT DOCUMENTS 5,186,089 A * 2/1993 Wadell ..... 83/56
5,215,496 A * 6/1993 Heiland ..... A22C 17/004 33/552
5,566,600 A * 10/1996 Johnson et al. ..... 83/77
5,937,080 A 8/1999 Vogeley, Jr. et al.
6,164,174 A * 12/2000 Sigurdsson et al. ..... 83/13
6,272,979 B1 8/2001 Morikawa et al.
6,549,823 B1 * 4/2003 Hicks et al. ..... 700/159
6,983,678 B2 * 1/2006 Wattles et al. ..... 83/102
7,055,419 B2 * 6/2006 Sandberg ..... 83/75.5
7,251,537 B1 * 7/2007 Blaine et al. ..... 700/29
7,524,241 B2 * 4/2009 Markert ..... 452/149
7,651,388 B2 * 1/2010 Faires et al. ..... 452/157
2002/0035905 A1 * 3/2002 Rosenberger ..... 83/13
2003/0145699 A1 * 8/2003 Kim et al. ..... 83/13
2006/0156878 A1 * 7/2006 Faires et al. ..... 83/13
2006/0288832 A1 * 12/2006 Sandberg ..... 83/75.5

FOREIGN PATENT DOCUMENTS

DE 4334107 C1 6/1995
DE 19612029 C1 7/1997
DK 9600164 U3 9/1997
EP 1044770 A 10/2000
JP 2002125581 A 5/2002
JP 2003180319 A 7/2003
WO W094/26479 A 11/1994

* cited by examiner

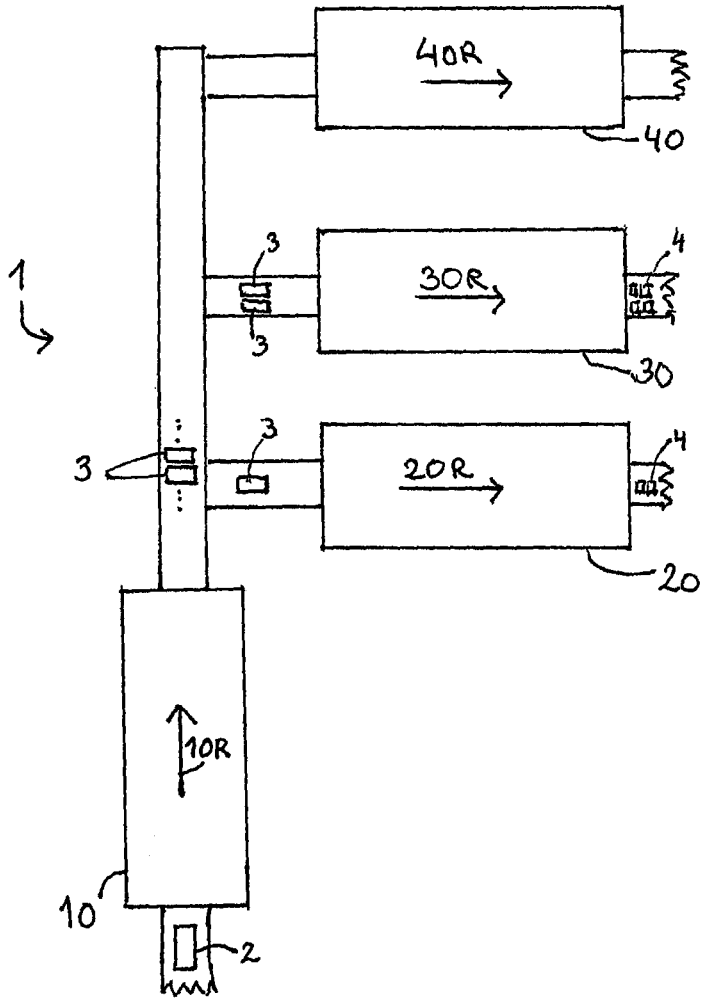
40R
40
3
4
30R
3
30
1
3
3
4
20R
20
10R
10
2

METHOD AND ARRANGEMENT FOR PORTION CUTTING OF FOOD ITEMS, AND USE OF A CUTTING DEVICE IN THE ARRANGEMENT

This patent application claims priority from prior PCT application No. PCT/DK2005/000194, filed 22 Mar. 2005, now Publication No. WO 2005/097438, which designated the U.S. and was published in the English language, and which claims priority from Danish patent application No. PA 2004 00552, filed 5 Apr. 2004, both herein incorporated by reference.

The invention relates to a method and an arrangement for the portion cutting of food items, especially meat products, in pieces of predetermined shapes, such as quadratic pieces of meat.

Within the foodstuffs industry, demands are made from time to time concerning special cuts of meat, an example of these being special portion cuts of poultry. The starting point for the meat cuts is e.g. de-boned leg and breast meat, where the remaining meat and skin are made "smooth" in one piece. Today, the cutting is carried out manually by persons who often have years of training, and the cut portions consists mainly of substantially quadratic pieces with a relatively precise size/weight.

Raw thigh and breast meat of chicken passes through the following processes:

1. Manual removal of bone and "smoothing-out" of the initial piece.
2. Manual fine-trimming of the initial piece, so that it is substantially whole and without loose skin, fat or meat shreds.
3. Manual portion cutting into quadratic pieces with a weight of around 20-25 g is carried out "by eye" following experience, and by removing parts of the meat which are not "regular".

This special portion cutting has hitherto only been performed manually, and it has shown that this gives rise to considerable disadvantages, especially in the third part of the process. In the first place, an experienced worker can produce only relatively few pieces of meat with acceptable size/weight within a given period of time, and secondly the meat wastage for an experienced cutter lies at around 17-20%, and considerably higher for an inexperienced cutter.

The international patent application WO94/26479 describes an apparatus for portion cutting of relatively regular food items, such as bone-free meat products, boiled ham, sausages etc. into uniform cubes, where the apparatus comprises two successively arranged cutting units. The first unit cuts in slices, and via a rotating knife the second unit cuts the slices into strips, which immediately afterwards are cut by a number of parallel knives into smaller, uniform cubes. The cubes are generally used as components in ready-prepared dishes, including toppings for pizza, and are therefore of relatively small size.

This known apparatus, and other known apparatuses of the same type which comprise a number of stationary parallel knives, are limited in their use, the reason being that they are not suitable for the cutting-up of food items in larger, more complex portions, since there is no possibility for adjustment of the cutting-up individually to the contour of the initial item, i.e. a varying breadth and thickness of the initial pieces and/or irregular surfaces on the food item.

Thus with the manual cutting the problem exists in the low speed with which the pieces are cut-up, even by a trained worker, in the relatively long time which is used in the training of a worker, and in the high degree of meat wastage, i.e. seen as a whole, the low output achieved with manual cutting.

It is in light of this that the object of the present invention is to make it possible for a cutting-up into special portions to be carried out in a substantially quicker and more accurate manner than the present manual cutting, whereby said portion cutting also results in less meat wastage.

Furthermore, it is an object of the invention to enable other more complex, larger portion cutting of a food item.

This object is achieved by a method and an arrangement for portion cutting of food items, especially meat products, in pieces of predetermined weight and dimensions, such as quadratic pieces of meat, where the cutting is effected in two cutting stages, where the first stage prepares the item by cutting the item into parts, which in the second cutting stage are cut into pieces of predetermined weight and dimension.

The method preferably comprises the following stages:

- transport of the items in a first feeding direction in a first cutting arrangement, in which arrangement the items are cut-up into strips in a cutting unit,
- transfer of the strips from the first cutting arrangement to one or more further cutting arrangements with second/other feeding direction/feeding directions different from the first feeding direction, and
- cutting-up in the one or more further cutting arrangements, in which further cutting arrangement/arrangements the strips are cut in a cutting unit into pieces of predetermined weight and dimensions, such as rectangular meat pieces.

There is hereby provided a method which makes it possible to perform a cutting-up into said mentioned portions, and this is effected in both a quick and profitable manner by an automation of the hitherto manual process. With the invention, there can be achieved an improvement in efficiency from the present few pieces per hour with the manual cutting to more than 1000 per minute by use of the three additional cutting units In a preferred example embodiment, in the first cutting device there is carried out a first measuring of the shape, structure and/or dimension of the food item. It is hereby made possible that a scanning of the shape/structure of the food item can form the basis for a planning of the cutting profile, and that the cutting can be carried out in accordance with this profile and direct the strips to the additional cutting device or devices. Moreover, preferably in the one or more additional cutting devices, there is performed a further measurement of the shape, structure and/or dimension of the strip. It is herewith possible to verify or correct the first measurement from the first cutting device for a possible alteration of the cutting profile for the additional cutting device(s).

In a preferred embodiment, in connection with the first measurement and on the basis of predetermined dimensions and/or weight of the pieces, a cutting profile is determined where at least a part of this cutting profile is carried out by the first cutting device. The dimensions and/or the weight of the strips and the cutting-up of these can herewith be precisely determined, and the cutting profile of this can be planned on the basis of the shape/appearance of the food item. The food item is preferably pre-cut to an approximately rectangular shape, which makes it relatively simple to determine a cutting profile for the item. The first cutting device can herewith be provided with a control programme which plans the whole of the cutting sequence, i.e. also the cutting-up in the remaining cutting units.

In an example embodiment, at least a part of said cutting profile is communicated further to the additional cutting device(s). By a simple appropriate programming of just one of the cutting devices, the whole of the cutting profile for the food items can herewith be communicated further for execution by the additional cutting devices.

In an example embodiment, two or more of the other feeding directions lie substantially parallel with one another, and in another embodiment one or more of the feeding directions lie substantially at right-angles to the first feeding direction. Rectangular, quadratic pieces can hereby be produced in a simple manner solely by a simple transfer of the strips between the first and the additional cutting device(s).

The method preferably comprises manual positioning of the food items in the first cutting device, and/or manual transfer of the strips to one or more of the additional cutting devices. By the placing of items or transfer of strips either "by eye" or on the basis of a planned portion-cutting-profile, each operator can place each item/strip in/for the cutting device.

In another example embodiment, the method further comprises non-manual placing of the food items in the first cutting device and/or non-manual transfer of the strips to one or more of the additional cutting devices. Automatically and without the need for manual positioning, there can hereby be achieved an appropriate placing for cutting into pieces with predetermined dimensions and weight.

In a second aspect of the invention, there is provided an arrangement for portion-cutting of food items, especially meat products, in pieces of predetermined weight and dimensions, such as quadratic pieces of meat, comprising a first cutting device which comprises a cutting unit for the cutting of the food items into strips during the transport in a first feeding direction, one or more additional cutting devices, each comprising a cutting unit for the cutting of the strips into pieces of predetermined weight and dimensions, such as quadratic pieces of meat, during transport in other feeding directions different from the first feeding direction and after transfer. The arrangement can herewith expediently carry out a precise and profitable portion-cutting, such as e.g. the special cutting of pieces of predetermined dimensions/weight. Moreover, the arrangement can make it possible that known cutting devices can be used in the setting-up of the arrangement, which makes the overall arrangement relatively cheap in development costs.

A second aspect of the invention comprises the use of a cutting device in an arrangement according to the invention, and with one use the said cutting device is arranged to send at least a part of the cutting profile further to other cutting devices. The two or more cutting devices, which are in an arrangement according to the invention, can herewith mutually communicate between or from the processor means.

In the following, the invention is described in more detail with reference to the enclosed drawing, where FIG. 1 shows an arrangement in one embodiment of the invention.

From Danish utility model no. DK 96 00164 U3, a cutting apparatus is known for portion cutting of food items. Herein there is described a machine for portion cutting of food items which comprises a cutting unit for the cutting of the items, which by a first and second conveyor respectively are fed past the cutting unit. A scanning system for detecting the shape of the items is arranged at the first conveyor. The shape of the items is registered in computer means which, on the basis of the shape of the items and control of the transport speed of the first conveyor, can control the machine for the portion cutting of the items with a predetermined weight, length or size.

As will appear from FIG. 1, in one embodiment of the invention an arrangement 1 for portion cutting of food items 2 into quadratic portions 4, especially meat products, comprises four cutting devices 10, 20, 30, 40, where a first cutting device 10 cuts the food items 2 into strips 3 and has three further cutting devices 20, 30, 40 placed downstream of said first cutting device for the cutting of the strips 3 into quadratic meat pieces 4, which can be sent further (not shown) for additional pre-processing, such as further cutting, packing and/or storage. These cutting devices can be of the type described in DK 96 00164 U3, but can naturally also be of another type, possibly with other forms of cutting units or scanning means, and the computer means can be individual for each individual cutting device or can be common to them all, possibly in communication with one another.

The expression strips 3 is to be understood to comprise a cut-up food item which, independent of the thickness of the item, is a strip of varying width.

As shown in FIG. 1, the first cutting device 10 has a first feeding direction indicated by an arrow 10R, and the three further cutting devices 20, 30, 40 have other feeding directions indicated respectively by the arrows 20R, 30R and 40R, where the other feeding directions lie parallel with one another and at right-angles to the feeding direction 10R, i.e. that they lie with feeding directions which are different from the first feeding direction 10R. It is obvious that if one can envisage that the other feeding directions 20R, 30R and 40R lie turned 180 degrees in relation to the first feeding direction 10R, they will also lie with feeding directions which differ from the first feeding directions 10R.

The transfer of strips 3 between the first cutting device 10 and one or more of the subsequent cutting devices 20, 30, 40, which extend in a substantially parallel manner, can for example with said special portion cutting expediently be carried out manually in accordance with a planned portion-cutting profile on the basis of the measurement from the scanning means and/or be carried out "by eye". Alternatively, transfer means such as conveyors with deflector means can be placed where the transfer and therewith the placing of the strip in the one or more of the further cutting devices is possibly controlled by the portion-cutting arrangement's computer means.

The placing of the food item 2 at the feed-in to the first cutting device 10 is of importance for the scanning and the planning of the portion-cutting profile, which is carried out by the processing means on the basis of predetermined requirements and dimensions and/or weight of the meat pieces 4 submitted to the computer. A manual placing based on the shape of the item can further increase the accuracy of the arrangement and reduce the percentage of wastage, for the reason that the output item can as mentioned be uniform in shape, thickness and width. A placing of the items based on scanning and transfer of each of the items/strips 2,3 is naturally also an obvious possibility.

The four cutting devices 10, 20, 30, 40 are placed in relation to one another in such a manner that the first cutting device 10 can receive the food items 2 to be cut, for the scanning and cutting of these into strips, which individually or several together are transferred to each of the three further cutting devices 20, 30, 40.

With the invention it is realised that two or more of the further cutting devices can be cutting devices 30 with two or more tracks, as shown in the figure.

The said special portion-cut items have dimensions with a length of less than twice the width and height, approx. 25×25 mm and a weight of around 18-32 g, but others can naturally be defined by the arrangement according to the invention.

In an arrangement according to a preferred embodiment of the invention, with a set-up which resembles that shown in FIG. 1, but without the cutting device 40, 130 items per minute can be cut on the cutting device 10, and thereafter the strips shall be distributed in three lines with 1-track cutting device 20 and a 2-track cutting device 30. When the 130 original items have such a size that they can each be cut into three strips 4, they become 390 strips in all. If the strips are distributed on the three tracks in a uniform manner, they become 130 strips per track per minute. When these strips can each be cut into three quadratic pieces, they become 1170 diced items per minute for three lines. If these diced items each weigh 22 g, the collective result is 25.74 kg per minute, which corresponds to 1544 kg per hour. On this basis it is calculated collectively that said arrangement can save 8 operators.

What is claimed is:

1. A method for portion cutting a food item into pieces having predetermined dimensions, comprising the steps of:

using a first measuring device for performing a first measuring step of measuring a shape, structure, and/or dimension of the food item;

using a result of said first measuring step for automatically determining a cutting sequence for cutting the food item into pieces having said predetermined dimensions, said cutting sequence including a strip cutting profile for cutting the food item into a plurality of strips, and also including a first piece cutting profile for cutting at least one of said strips into pieces having said predetermined dimensions;

automatically cutting the food item into said strips at a first cutting device according to said strip cutting profile, the cutting of the food item into said strips being transversal to a feeding direction through said first cutting device;

transporting the at least one of said strips to a second cutting device, wherein a first strip orientation of said strips relative to the feeding direction through said first cutting device is approximately right-angled to a second strip orientation of said strips relative to a feeding direction through said second cutting device;

using a second measuring device for performing a second measuring step of measuring a shape, structure, and/or dimension of the at least one of said strips;

using a result of said second measuring step for automatically determining a second piece cutting profile for cutting said at least one of said strips into pieces having said predetermined dimensions, wherein said second piece cutting profile is different than said first piece cutting profile; and automatically cutting said at least one of said strips into pieces having said predetermined dimensions at the second cutting device based on said second piece cutting profile, the cutting of said strips into said pieces being transversal to the feeding direction through said second cutting device.

2. The method of claim 1, wherein said second piece cutting profile is an alteration of said first piece cutting profile.

3. The method of claim 1, wherein said step of automatically determining a portion-cutting profile is performed at the first cutting device, and wherein the step of automatically determining said second piece cutting profile is performed at the second cutting device.

4. The method of claim 1, wherein said second measuring device is located at said second cutting device.

5. The method of claim 1, wherein said portion cutting of the food item is into pieces having both predetermined dimensions and predetermined weight, and wherein said predetermined weight is utilized together with said predetermined dimensions by the step of automatically determining the cutting sequence to determine a cutting sequence for cutting the food items into pieces having the predetermined dimensions and predetermined weight.

6. The method of claim 5, wherein said predetermined weight is also utilized together with said predetermined dimensions by the step of automatically determining the second piece cutting profile to obtain the pieces having the predetermined dimensions and predetermined weight.

7. The method of claim 5, wherein said predetermined dimensions is also utilized together with said predetermined weight by the step of automatically determining the second piece cutting profile to obtain the pieces having the predetermined weight and predetermined dimensions.

8. The method of claim 1, wherein said feeding direction through said second cutting device lies at approximately right-angles to said feeding direction through said first cutting device.

9. The method of claim 1, wherein said first cutting device comprises a rotating knife transversal to said feeding direction through the first cutting device, and wherein said second cutting device comprises a rotating knife transversal to said feeding direction through said second cutting device.

10. A method for portion cutting a food item into pieces having predetermined dimensions, comprising the steps of:

using a first measuring device for performing a first measuring step of measuring a shape, structure, and/or dimension of the food item;

using a result of said first measuring step for automatically determining a cutting sequence for cutting the food item into pieces having said predetermined dimensions, said cutting sequence including a strip cutting profile for first cutting the food item into a plurality of strips, and also including a first piece cutting profile for cutting each one of said strips into pieces having said predetermined dimensions;

automatically cutting the food item into said strips at a first cutting device according to said strip cutting profile, the cutting of the food item into said strips being transversal to a feeding direction through said first cutting device;

transporting at least one of said strips to one of a plurality of second cutting devices, wherein a first strip orientation of said strips relative to the feeding direction through said first cutting device is approximately right-angled to a second strip orientation of said strips relative to a feeding direction through the one of the second cutting devices;

using a further measuring device located at the one of the second cutting devices for performing a second measuring step of measuring a shape, structure, and/or dimension of said at least one of said strips;

using a result of said second measuring step for automatically determining a second piece cutting profile for cutting said at least one of said strips into pieces having said predetermined dimensions, wherein said second piece cutting profile is different than said first piece cutting profile; and automatically cutting said at least one of said strips into pieces having said predetermined dimensions using the one of the second cutting devices, the cutting of said strips into said pieces being transversal to the feeding direction through the one of the second cutting devices, and wherein others of said strips are transported to others of said plurality of cutting devices.

11. The method of claim 10, wherein said portion cutting of the food item is into pieces having both predetermined dimensions and predetermined weight, and wherein said predetermined weight is utilized together with said predetermined dimensions by the step of automatically determining the cutting sequence to determine a cutting sequence for cutting the food items into pieces having the predetermined dimensions and predetermined weight.

12. The method of claim 11, wherein said predetermined weight is also utilized together with said predetermined dimensions by the step of automatically determining the second piece cutting profile to obtain the pieces having the predetermined dimensions and predetermined weight.

13. The method of claim 10, wherein said feeding direction through the one of the second cutting devices lies at approximately right-angles to said feeding direction through said first cutting device.

14. The method of claim 10, wherein said first cutting device comprises a rotating knife transversal to said feeding direction through the first cutting device, and wherein the one of the plurality of second cutting devices comprises a rotating knife transversal to said feeding direction through the one of the second cutting devices.

15. A method for portion cutting a food item into pieces having a predetermined weight, comprising the steps of:

using a first measuring device for performing a first measuring step of measuring a shape, structure, and/or dimension of the food item;

using a result of said first measuring step for automatically determining a cutting sequence for cutting the food item into pieces having said predetermined weight, said cutting sequence including a strip cutting profile for first cutting the food item into a plurality of strips, and also including a first piece cutting profile for cutting at least one of said strips into pieces having said predetermined weight;

automatically cutting the food item into said strips at a first cutting device according to said strip cutting profile, the cutting of the food item into said strips being transversal to a feeding direction through said first cutting device;

transporting the at least one of said strips to a second cutting device, wherein a first strip orientation of said strips relative to the feeding direction through said first cutting device is approximately right-angled to a second striporientation of said strips relative to a feeding direction through said second cutting device;

using a second measuring device for performing a second measuring step of measuring a shape, structure, and/or dimension of at least one of said strips;

using a result of said second measuring step for automatically determining a second piece cutting profile for cutting said at least one of said strips into pieces having said predetermined weight, wherein said second piece cutting profile is different than said first piece cutting profile; and automatically cutting said at least one of said strips into pieces having said predetermined weight at the second cutting device based on said second piece cutting profile, the cutting of said strips into said pieces being transversal to the feeding direction through said second cutting device.

16. The method of claim 15, wherein said portion cutting of the food item is into pieces having both predetermined weight and predetermined dimensions, and wherein said predetermined dimensions is utilized together with said predetermined weight by the step of automatically determining the cutting sequence to determine a cutting sequence for cutting the food items into pieces having the predetermined weight and predetermined dimensions.

17. The method of claim 15, wherein said feeding direction through said second cutting device lies at approximately right-angles to said feeding direction through said first cutting device.

18. The method of claim 15, wherein said first cutting device comprises a rotating knife transversal to said feeding direction through the first cutting device, and wherein said second cutting device comprises a rotating knife transversal to said feeding direction through said second cutting device.

19. A method for portion cutting a food item into pieces having predetermined dimensions, comprising the steps of:

using a first measuring device for performing a first measuring step of measuring a shape, structure, and/or dimension of the food item;

using a result of said first measuring step for automatically determining a cutting sequence for cutting said food item into pieces having said predetermined dimensions, said cutting sequence including a strip cutting profile for first cutting said food item into a plurality of strips, and also including a firstpiece cutting profile for cutting each one of said strips into pieces having said predetermined dimensions;

automatically cutting said food item into said strips at a first cutting device according to said strip cutting profile, the cutting of the food item into said strips being transversal to a feeding direction through said first cutting device;

transporting said strips toward a plurality of second cutting devices, wherein each one of said strips is further transported to a selected one of the plurality of second cutting devices, and wherein a first strip orientation of said strips relative to the feeding direction through said first cutting device is approximately right-angled to a second strip orientation of said strips relative to a feeding direction through said selected one of the plurality of second cutting devices;

for each one of the strips, using a further measuring device located at the second cutting device for which the strip was selected for performing a second measuring step of measuring a shape, structure, and/or dimension of each one of the strips;

for each one of said strips, using a result of said second measuring step for automatically determining a second piece cutting profile for cutting each one of said strips into pieces having said predetermined dimensions, wherein said second piece cutting profile is different than said first piece cutting profile; and automatically cutting said strips into pieces having said predetermined dimensions using the selected second cutting devices, the cutting of said strips into said pieces being transversal to the feeding direction through said selected second cutting devices.

20. The method of claim 19, wherein said portion cutting of the food item is into pieces having both predetermined dimensions and predetermined weight, and wherein said predetermined weight is utilized together with said predetermined dimensions by the step of automatically determining the cutting sequence to determine a cutting sequence for cutting the food items into pieces having the predetermined dimensions and predetermined weight.

21. The method of claim 20, wherein said predetermined weight is also utilized together with said predetermined dimensions by the step of automatically determining the second piece cutting profile to obtain the pieces having the predetermined dimensions and predetermined weight.

22. The method of claim 19, wherein said feeding direction through the selected one of the plurality of second cutting devices lies at approximately right-angles to said feeding direction through said first cutting device.

23. The method of claim 19, wherein said first cutting device comprises a rotating knife transversal to said feeding direction through the first cutting device, and whereinsaid selected one of the plurality of second cutting devices comprises a rotating knife transversal to said feeding direction through said selected on of the plurality of second cutting devices.

* * * * *